United States Patent [19]

Isler

[11] Patent Number: 4,914,987

[45] Date of Patent: Apr. 10, 1990

[54] TUBE COUPLING TIGHTENING TOOL

[75] Inventor: Mathew J. Isler, Port Jefferson, N.Y.

[73] Assignee: Grumman Aerospace Corporation, Bethpage, N.Y.

[21] Appl. No.: 246,715

[22] Filed: Sep. 20, 1988

[51] Int. Cl.[4] ..... B25B 13/00

[52] U.S. Cl. ..... 81/57.46; 81/56

[58] Field of Search ..... 81/55.57, 57.13, 57.29, 81/57.46

[56] References Cited

U.S. PATENT DOCUMENTS

| | | | |
|---|---|---|---|
| 2,764,048 | 9/1956 | Thompson | 81/57.29 |
| 2,795,985 | 6/1957 | Wilson . | |
| 2,907,242 | 10/1959 | Chakroff . | |
| 3,097,551 | 7/1963 | Schmitt | 81/56 X |
| 4,186,629 | 2/1980 | Costes . | |

FOREIGN PATENT DOCUMENTS

| | | | |
|---|---|---|---|
| 688061 | 1/1930 | France . | |
| 707988 | 11/1951 | United Kingdom . | |
| 750892 | 6/1956 | United Kingdom | 81/56 |

*Primary Examiner*—James G. Smith

*Attorney, Agent, or Firm*—Pollock, VandeSande & Priddy

[57] ABSTRACT

Tubing sections may be coupled together by employing a removable tool that is worm gear driven. The worm gear turns an inner body of the tool which in turn causes rotation of a rotatable coupling fitting. The utilization of a worm driven tool attached to the outer body eliminates the generation of torque which is highly desirable for a user making repairs or installations in outer space.

2 Claims, 1 Drawing Sheet

TUBE COUPLING TIGHTENING TOOL

FIELD OF THE INVENTION

The present invention relates to a removable tool for tightening couplings, and more particularly to such a tool utilizing a worm gear for generating necessary rotational tightening forces.

BACKGROUND OF THE INVENTION

In space-limited facilities where hydraulic and pneumatic tubes or pipes are present, it is difficult to tighten couplings using common open-ended wrenches. The prior art includes a number of devices which are gear-driven coupling devices that may be powered from a fixed point thereby avoiding the necessity of large arcuate swing areas that must be present for open-ended wrench turning. However, in the past such prior art devices have been integral with the coupling so that the tool cannot be removed. This presents three major drawbacks. The first is the expense involved in the necessary hardware for each coupling; the second and third disadvantages are the additional space and weight. The latter disadvantages are of particular importance in space vehicles where both weight and space are at a premium.

BRIEF DESCRIPTION OF THE INVENTION

The present invention avoids these disadvantages by offering a gear-driven removable tightening tool for tube or pipe couplings. Since the tool can be removed, it can be repeatedly used whenever a coupling must be assembled or tightened. This results in the avoidance of high cost and drastically reduces the size and weight requirements of prior art devices as just discussed.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE INVENTION

Figure 1:
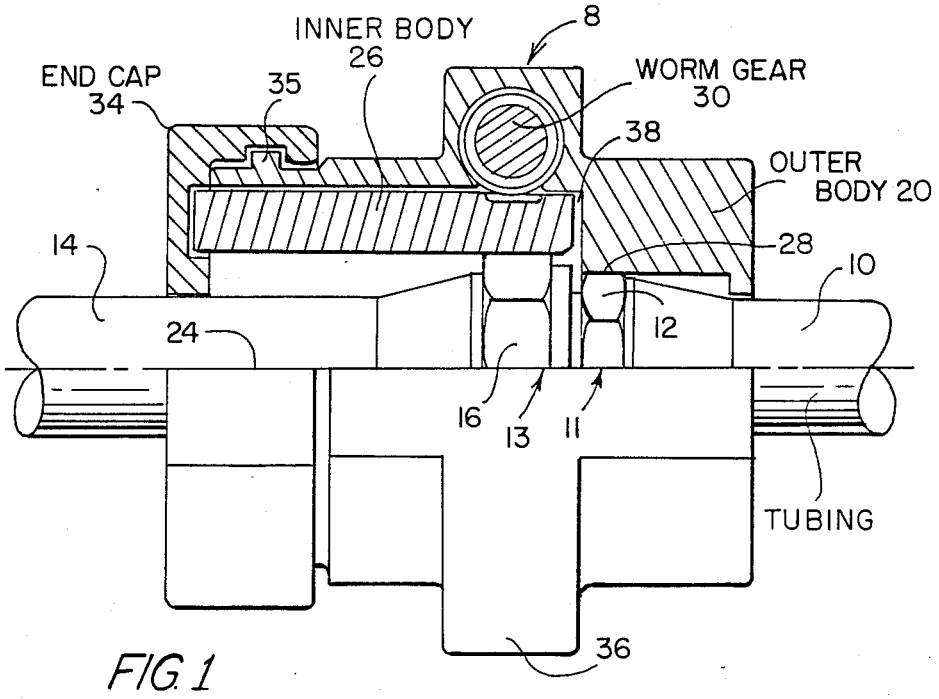
FIG. 1 is a partial longitudinal sectional view through the present tool.

In FIG. 1 the tool of the present invention is generally illustrated by reference numeral 8. The tool is positioned over two mating lengths of tubing 10 and 14 which respectively mount a male coupling 11 and female coupling 13. After the couplings have been hand-tightened, the present tool is employed to securely fasten the male and female couplings together. The male coupling 11 has a fixed nut-shaped fitting 12 while the female coupling 13 has a rotatable nut-shaped fitting 16.

The tool 8 is generally characterized by an outer body which remains generally fixed relative to the tubing sections 10 and 14 and an inner body 26 which is movable with respect to the tubing sections.

Figure 2:
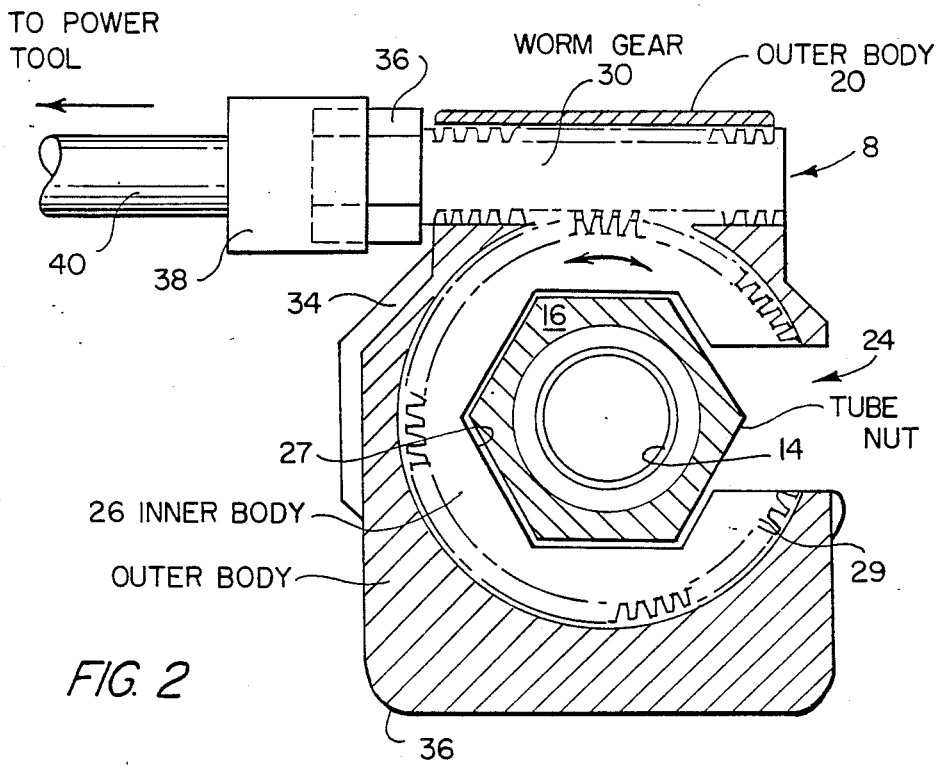
FIG. 2 is a partial transverse sectional view through the tool of the present invention.

As illustrated in FIG. 2, the outer body has an elongated longitudinal opening 24 for receiving the tubing sections 10 and 14 and their respective couplings 11 and 13. Before the hand-tightened tubing sections are inserted within the inner body 26, the inner body 26 is displaced to the left relative to the position illustrated in FIG. 1, so that there is no interference between the rotatable fitting 16 and the inner body 26. Also, end cap 34 is removed from the outer body when the tubing sections are inserted within the tool. After insertion of the tubing sections, the outer body 20 is moved relative to the fixed fitting 12 until contact is made between the lands of the male fitting 12 and the oppositely positioned surface 28 of the outer body 20. When this occurs, the tubing section 10 becomes fixed relative to the outer body 20 due to the fact that the fitting 12 does not rotate relative to the tubing section 10.

As seen in FIG. 2, the inner body 26 has a generally hexagonal axial cut-out 27 for receiving fitting 16 having an identical profile. The inner body 26 is foreshortened at the forward edge of the tool so that opening 24 extends through the forward portion of the inner body 26. The outer periphery of inner body 26 has gear teeth 29 formed therein to mesh with the gear teeth of a worm gear 30 which extends in spaced orthogonal relationship to the axis of tool 8. The outer end of worm gear 30 has a hexagonal head 36 so that a removable mating sprocket 38 and drive shaft 40 may engage the worm gear 30 and cause it to turn. In a preferred embodiment of the invention, the shaft 40 is connected to a power tool that translates the worm gear in turn causing rotation of the inner body 26 and commensurate tightening (or loosening) of the tubing couplings. It is anticipated that the present invention may be utilized in space and it generates a zero or negligible torque when the body of the power tool is fastened to the outer body 20, which is of great operational desirability in space.

In order to maintain secure engagement between worm gear 30 and inner body 26, an end cap 34 (FIG. 1) is fastened to the left-illustrated end of the outer body 20 by means of a convenient retainer such as detent 35. By maintaining secure engagement between worm gear 30 and inner body 26, the end cap (or similar closure) ensures smooth gearing action therebetween.

Thus, as will be appreciated from the aforementioned description, the present invention offers the user a removable tool which can be repeatedly used to tighten (or loosen) various tubing couplings. Further, as previously mentioned, the tool of the present invention may be employed to install or repair couplings in fluid lines or the like in a low gravity space environment without producing a resultant torque that might otherwise turn an astronaut, thus making installation or repair difficult in space.

It should be understood that the invention is not limited to the exact details of construction shown and described herein for obvious modifications will occur to persons skilled in the art.

I claim:

1. A tool for tightening first and second fittings of a tube coupling comprising:

an outer body having a longitudinally extending slot for removably receiving the first and second fittings and their respectively attached tube sections, an interior surface of the outer body being planar to contact a flat of a nut-shaped first fitting to maintain the fitting in a fixed position;

an inner body coaxially disposed within the outer body and having a longitudinally extending slot alignable with the outer body slot, the inner body further having (a) a radially inner surface with a substantially polygonal profile for engaging the second fitting, and (b) a radially outer surface area with gear means formed thereon;

a worm gear disposed in the outer body and extending into the inner body for meshing with the gear means formed on the inner body which enables rotation of the second fitting upon driving of the worm gear thus resulting in tightening of the coupling; and closure means removable for permitting axial displacement of the inner body thereby creating sufficient space for insertion of the fitting and attached tube sections through the aligned slots, replacement of the inner body and closure means allowing engagement between the polygonal profile and the second fitting, the closure means urging the gear means of the inner and outer bodies together to ensure their continued meshing.

2. The structure set forth in claim 1 together with means for attaching a power tool to the worm gear means for quickly driving it.

* * * * *